US005161307A

United States Patent [19]

Althaus

[11] Patent Number: 5,161,307

[45] Date of Patent: Nov. 10, 1992

[54] RAZOR HEAD, ESPECIALLY RAZOR BLADE UNIT, OF A WET RAZOR

[75] Inventor: Wolfgang Althaus, Wuppertal, Fed. Rep. of Germany

[73] Assignee: Wilkinson Sword Gesellschaft mit beschränkter Haftung, Solingen, Fed. Rep. of Germany

[21] Appl. No.: 688,152

[22] Filed: Apr. 19, 1991

[30] Foreign Application Priority Data

Apr. 27, 1990 [DE] Fed. Rep. of Germany ... 900476[U]

[51] Int. Cl.[5] ..... B26B 21/14

[52] U.S. Cl. ..... 30/77; 30/50

[58] Field of Search ..... 30/41, 51, 32, 27, 84, 30/90, 34.05, 50

[56] References Cited

U.S. PATENT DOCUMENTS

| | | | |
|---|---|---|---|
| 3,137,939 | 6/1964 | Waldeck | 30/90 X |
| 4,875,287 | 10/1989 | Creasy et al. . | |
| 5,036,587 | 8/1991 | Trotta et al. | 30/41 |

FOREIGN PATENT DOCUMENTS

| | | |
|---|---|---|
| 0276094 | 7/1988 | European Pat. Off. . |
| 2851457 | 6/1979 | Fed. Rep. of Germany . |
| 1157640 | 7/1969 | France . |
| 2009017 | 6/1979 | United Kingdom . |

*Primary Examiner*—Douglas D. Watts

*Attorney, Agent, or Firm*—Robert W. Becker & Associates

[57] ABSTRACT

A razor head, and especially a razor blade unit, is disposed at the front end of a handle of a wet razor and includes a plastic body that comprises a front guide strip and a rear cover. A single or double razor blade is disposed in the plastic body. The cover is provided with a glide strip that is convexly curved.

4 Claims, 6 Drawing Sheets

RAZOR HEAD, ESPECIALLY RAZOR BLADE UNIT, OF A WET RAZOR

BACKGROUND OF THE INVENTION

The present invention relates to a razor head, and especially a razor blade unit, that is disposed at the front end of a handle of a wet razor. The razor head has a plastic body that comprises a forward guide strip and a rear cover, with a razor blade means in the form of a single or double razor blade being disposed in the plastic body. The cover is provided with a glide strip.

Various embodiments of wet or safety razors are known. In each case, disposed at the front end of a handle is a razor head that carries the single or double razor blade. The razor head can be integrally formed with the handle as a molded plastic part. If the razor head is separate from the handle and is to be secured thereto in an exchangeable manner via an appropriate mechanism, it is designated as a so-called razor blade unit, with a single or double razor blade being fixedly embedded in a plastic housing.

Various embodiments of razor heads in the form of such razor blade units are known. Basically, a plastic body is provided in which a single or double razor blade is fixedly embedded.

In the vicinity of the cutting edge or edges of the razor blade or blades, the plastic body has a forward guide strip, whereas a cover is provided in the rear region. This cover can be provided with a friction-reducing glide strip that with the heretofore known embodiments is always flat, i.e. has a planar configuration. Although the known glide strip reduces friction between the razor head and the skin of a user and thus to some extent provides an improved shave, it is not particularly effective at the end of the razor head. Furthermore, with these heretofore known embodiments it is always necessary for a relatively steep angle to be employed so that the first contact of the glide strip with the skin will initially be established at the upper edge. However, experiments have shown that in certain areas of the face, the subsequent, rear edge of the glide strip can be felt in a detrimental or even injurious manner, because the ability of the skin of the face to adapt to the blade is a function of the elastic condition of the skin. Numerous individual characteristics play a role in this respect, namely age, composition of the skin, fatty layer of the skin over bones, etc.

It is therefore an object of the present invention to provide a razor head, and especially a razor blade unit, of a wet razor of the aforementioned general type whereby an improved glide strip is provided and hence an improved gliding condition is provided.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
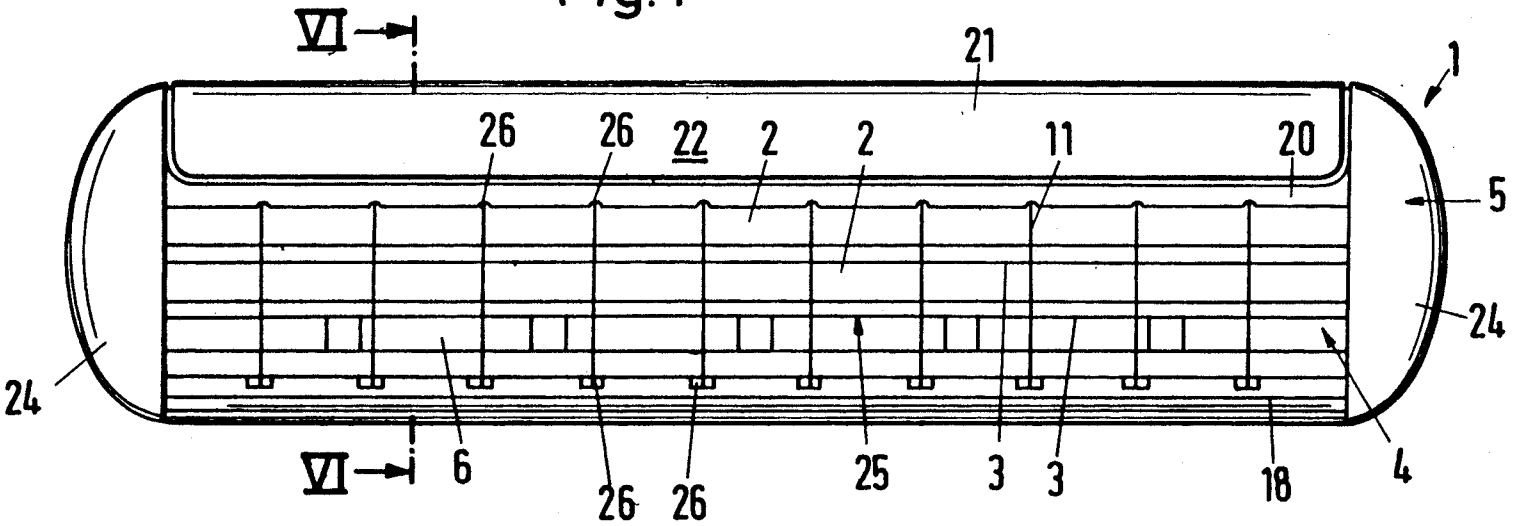
FIG. 1 is a top view of one exemplary embodiment of the inventive razor head in the form of a razor blade unit of a wet razor.
Figure 2:
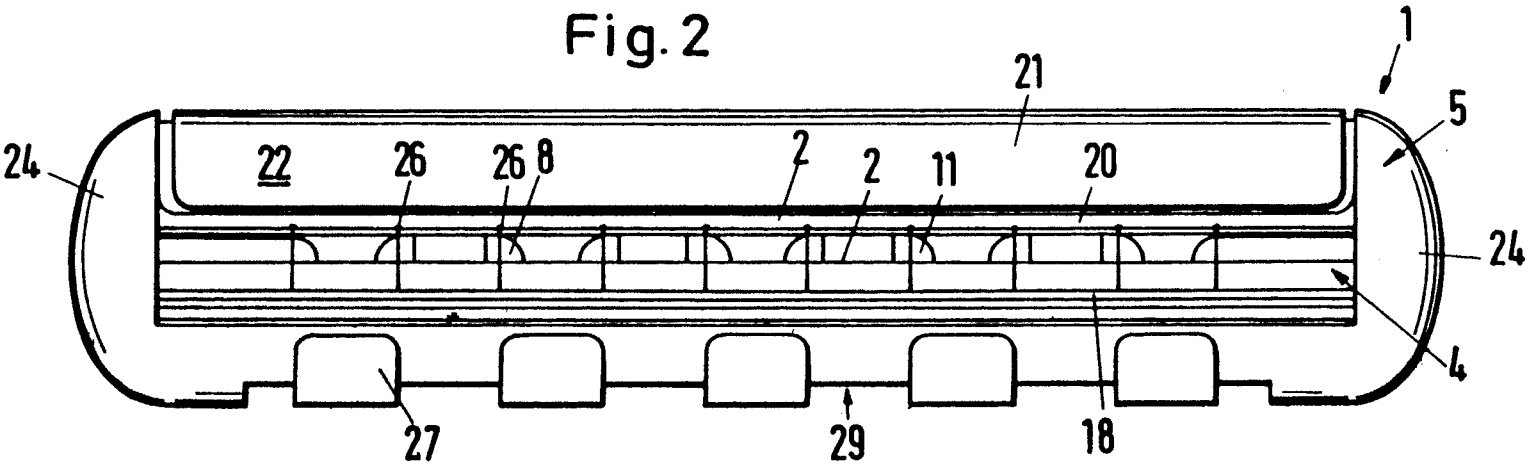
FIG. 2 is a front view of the razor blade unit of FIG. 1.
Figure 3:
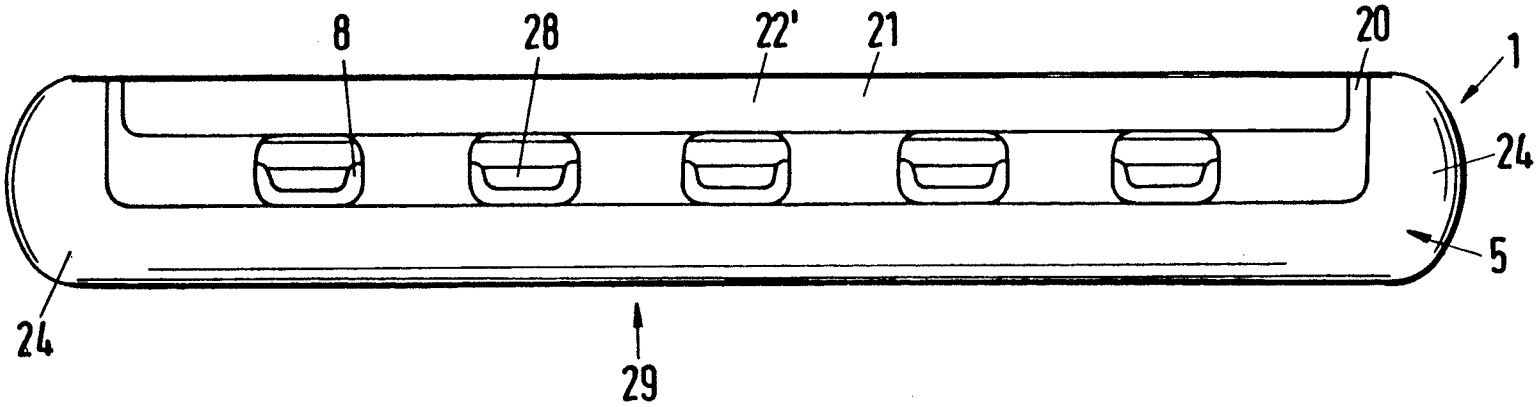
FIG. 3 is a rear view of the razor blade unit of FIG. 1.
Figure 4:
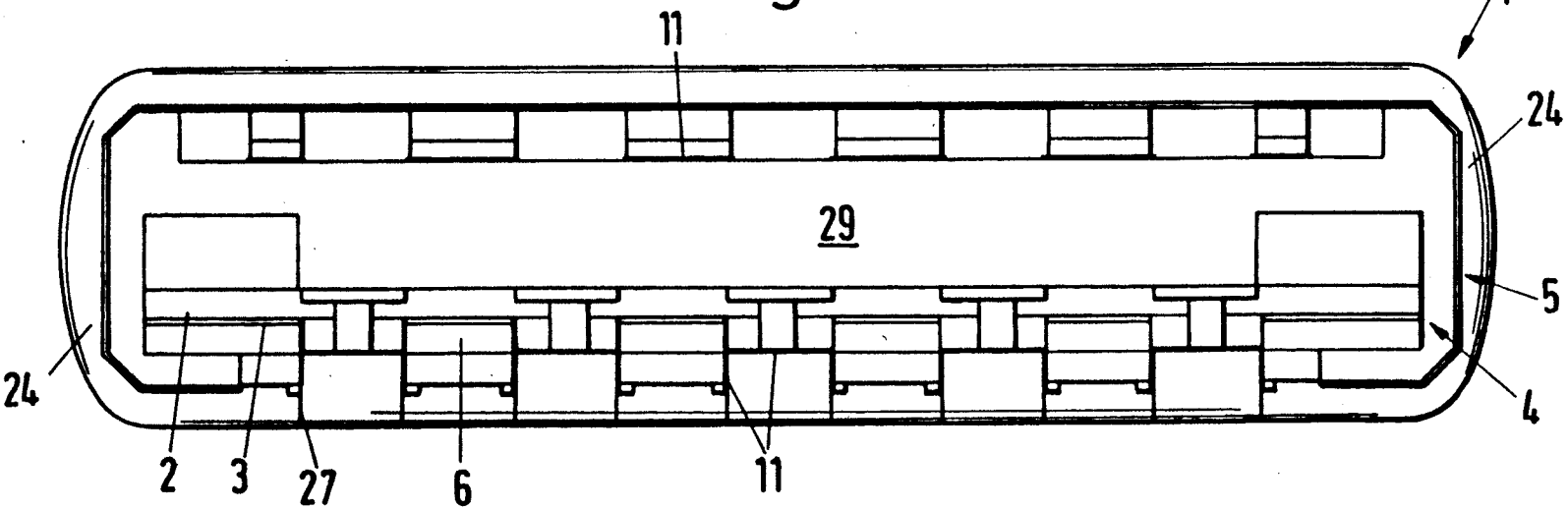
FIG. 4 is a bottom view of the razor blade unit of FIG. 1.
Figure 6:
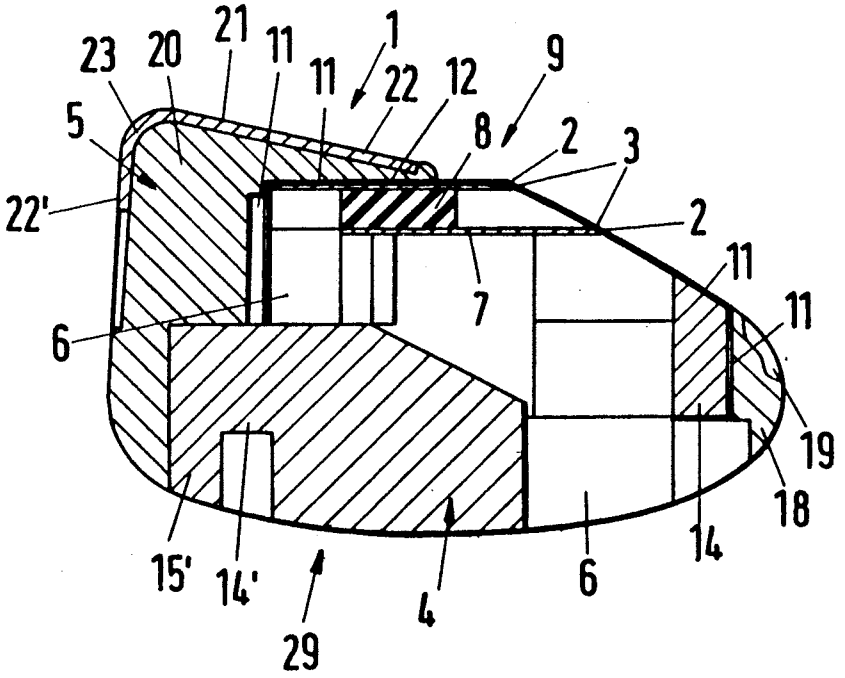
FIG. 6 is an enlarged cross-sectional view taken along the line VI-VI in FIG. 1.
Figure 5:
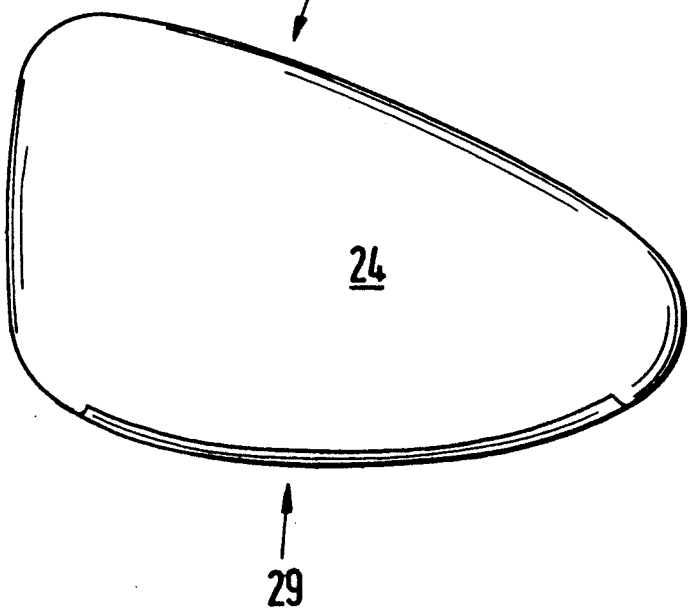
FIG. 5 is an enlarged side view of the razor blade unit of FIG. 1.
Figure 7:
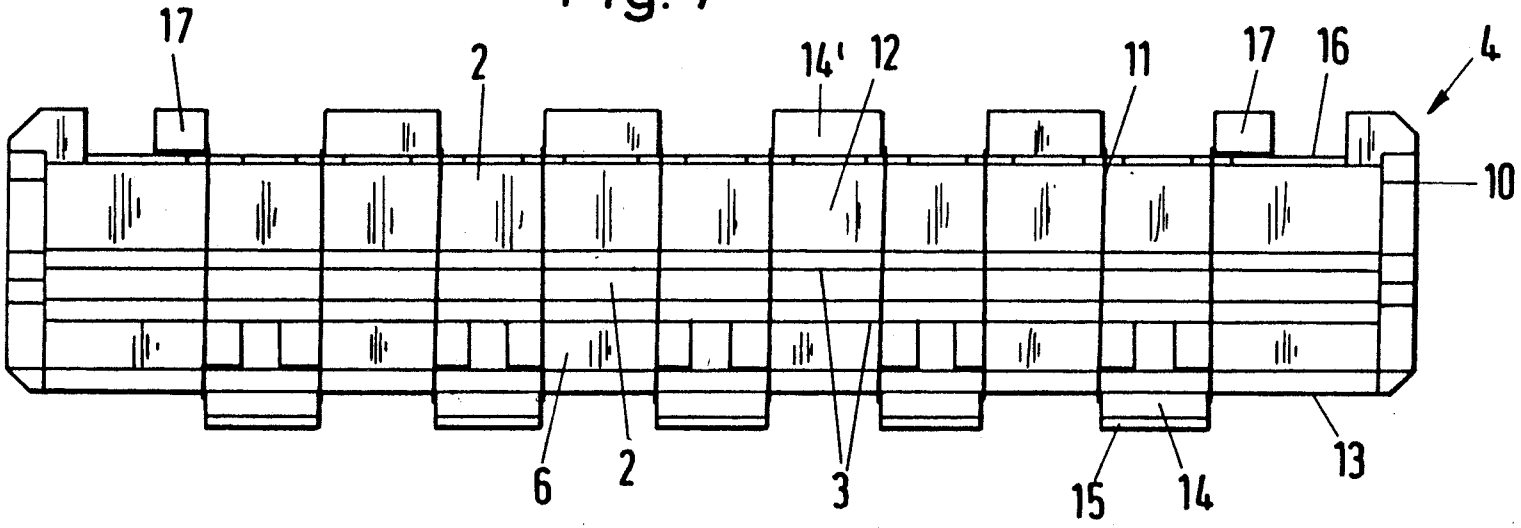
FIG. 7 is a top view of the base member of the razor blade unit without the upper part, which is formed by the forward guide strip, the rear cover, and the side walls.
Figure 8:
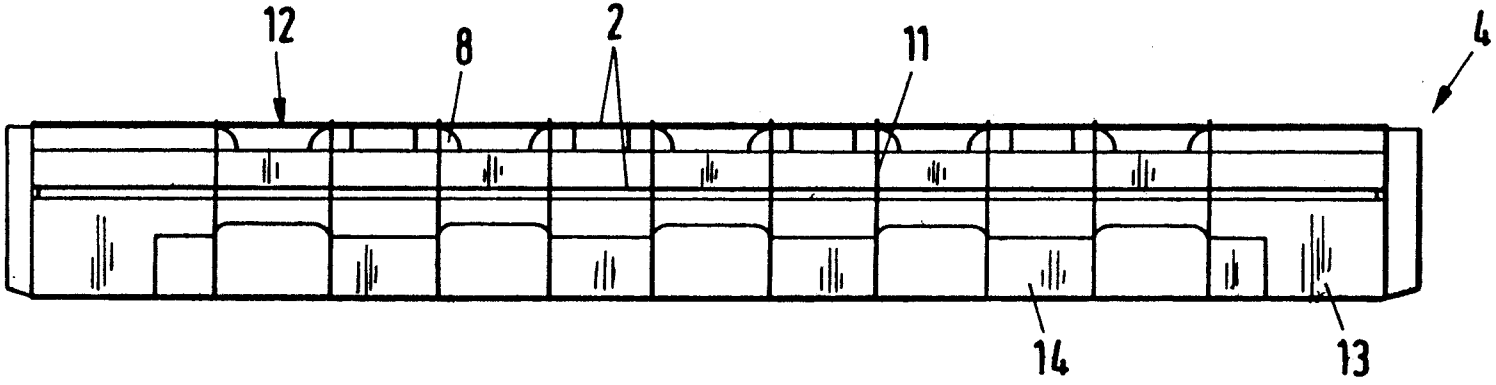
FIG. 8 is a front view of the base member.
Figure 9:
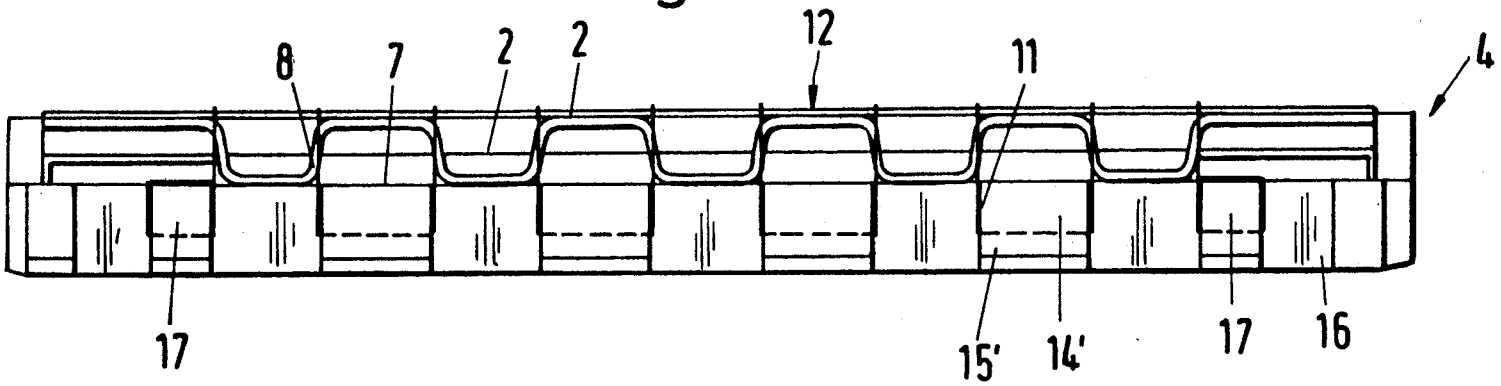
FIG. 9 is a rear view of the base member.
Figure 10:
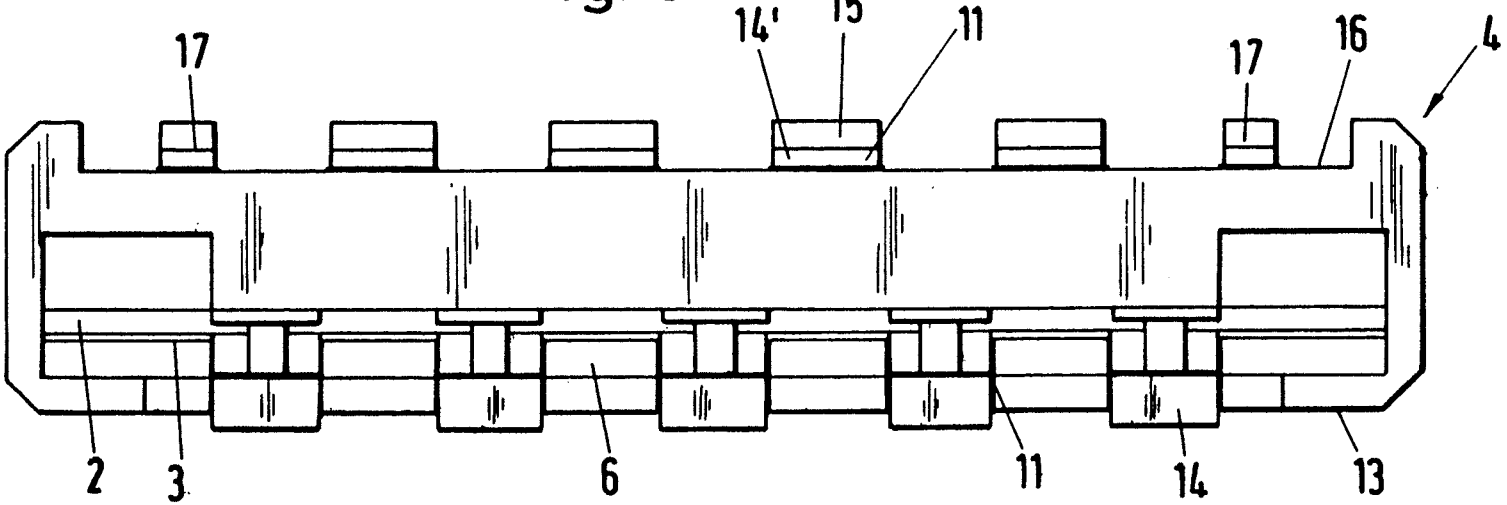
FIG. 10 is a bottom view of the base member.
Figure 11:
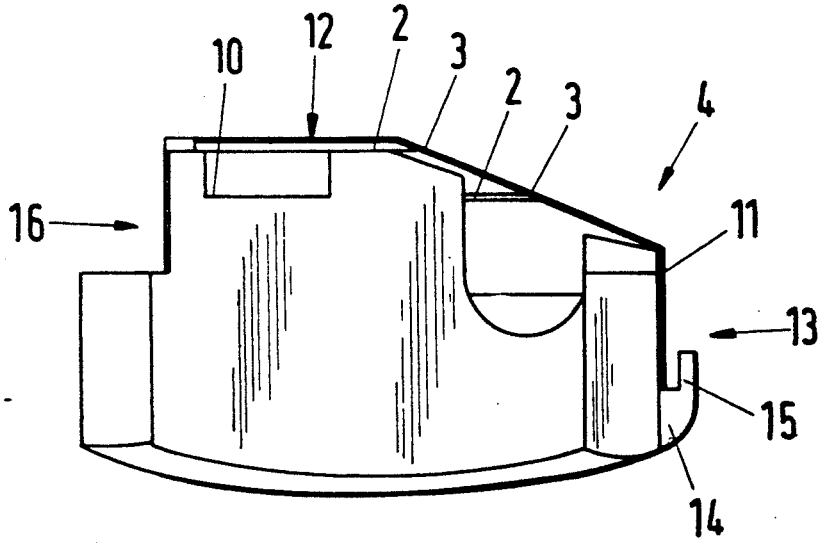
FIG. 11 is an enlarged side view of the base member.

The razor head of the present invention is characterized primarily in that the glide strip is convexly curved.

Such a glide strip that is curved over the cover is in particular in the form of a coated foil or sheet that is convexly formed into the edges about the cover and the line of curvature of which tends parallel to the cutting edge or edges of the razor blades; such a glide strip can be produced via a special hot molding process and can be applied. The particular advantage of such a configuration is that the glide strip is also more effective at the end of the razor head. Since the skin is made taut during shaving and is pressed in, a bulge is formed at the end of the razor head. The curved glide strip optimally glides in this region, and thus increases a comfortable shave. Due to the convex configuration of the foil or sheet that forms the glide strip, the shape of the cover is maintained even upon total loss of the glide strip, so that the razor geometry is always maintained. Finally, the inventive convexly curved glide strip in the form of a convexly curved foil or sheet represents a particularly economical embodiment for a razor head that is provided with a glide strip.

Pursuant to one preferred specific embodiment of the present invention, the glide strip has a forward, essentially planar or slightly convexly curved leg as well as a rear, similarly essentially planar or slightly convexly curved leg that is disposed at an angle to the forward leg, with these two legs being interconnected via a rounded portion. This represents an optimum shape for the glide strip with which an extremely comfortable shave is possible.

Pursuant to a further specific embodiment of the present invention, the top of the cover has a shallow recess in which the glide strip is received. By being accommodated within the cover, the glide strip does not project beyond the cover, rather conforming completely to the surface configuration thereof.

Finally, pursuant to a further specific embodiment of the present invention, the glide strip is a foil or sheet that is provided with a coating that has a gliding property. A foil o sheet coated in this manner has the advantage that it can be very easily applied to the cover in the prescribed convexly curved form.

Further specific features of the present invention will be described in detail subsequently.

DESCRIPTION OF PREFERRED EMBODIMENTS

Referring now to the drawings in detail, the illustrated razor head, which is in the form of a so-called razor blade unit for a wet or safety razor, and can be secured to the front end of a non-illustrated handle, comprises a plastic body 1 in which are disposed two razor blades 2, the cutting edges 3 of which extend parallel to one another and are offset one behind the other.

The plastic body 1 comprises a base member 4 that is provided with the razor blades 2, as well as an upper part 5 that is placed upon the base member 4.

The base member 4 of the plastic body 1 is provided with through slots 6 that are primarily disposed in the interior thereof. On the upper side, the base member 4 defines a platform or support means 7 for the razor blades 2. For this purpose, a spacer 8 is sandwiched between the two razor blades 2, which are securely connected to this spacer. These components thus form a razor blade/spacer/razor blade unit 9, which is placed from above upon the support means 7 of the base member 4. For this purpose, the spacer 8 projects out to the side and is received in recesses or slots 10 in the sides of the base member 4.

The unit 9 is held via a wire or other filament 11 that extends in a zigzagged or staggered manner; the wire 11 is guided over the upper side 12 of the unit 9, and hence of the base member 4 of the plastic body 1. To guide the wire 11, the lower portion of the front side 13 of the base member 4 is provided with downwardly directed, integral projections 14 that are embodied as elongated strips. The width of these projections 14 as viewed in the direction of the cutting edges 3 of the razor blades 2 essentially corresponds to the spacing between the projections 14. Toward the front, the projections 14 are provided with an upwardly extending extension 15.

In a similar manner, the back side 16 of the base member 4 is provided with projections 14' that are directed toward the rear. These projections 14' fill the gaps between the projections 14 of the front side 13. In a manner similar to the construction of the projections 14, the projections 14' are also provided with extensions 15', which, however, are directed downwardly. Finally, the back side 16 of the base member 4 is provided near its ends with respective integral mounting o securing projections 17.

One end of the wire 11 is first secured to one of the securing projections 17. Subsequently, the wire 11 is guided over the unit 9 toward the front and about a projection 14, whereupon it is turned by 180° to again extend toward the rear over the unit 9, where the wire 11 is guided about a pertaining projection 14'. The wire 11 is thus sequentially guided about the projections 14 and 14', whereupon the other end of the wire is finally secured to the securing projection 17 disposed at the other side of the base member 4. In this connection, portions of the wire 11 disposed in the region of the upper side 12 extend parallel to one another and essentially equidistantly from one another. The wire 11 serves a dual function of holding the unit 9 securely in place upon the support means 7 on the base member 4, and also preventing injury to the skin.

The upper part 5 is a one-piece plastic component and is provided with a forward guide strip 18 that extends parallel to the cutting edges 3 of the razor blades 2 and is provided with a stepped longitudinal profiling 19. A protective cover 20 is provided in the back region. This cover is provided at the top with a convexly curved glide or antifriction strip 21 having a first leg 22 and a second leg 22' that is disposed at an acute angle to the first leg 22 and is interconnected therewith via a rounded portion 23. The angle between the two legs 22, 22' of the glide strip 21 can also be 90° or an obtuse angle. The two legs 22, 22' of the glide strip 21 have an essentially planar or slightly convexly curved configuration. It is possible to produce such a glide strip 21 via a special hot mold process. The particular advantage of this glide strip 21 is that it is also more effective at the end of the razor blade unit. Since when shaving the skin is made taut and is pressed in, a bulge is formed at the end of the razor blade unit. Thus, the curved glide strip 21 glides better in this region and thus increases a comfortable shave.

The forward guide strip 18 and the rear cover 20 are interconnected by side walls 24. Disposed between these components is an opening 25 in the vicinity of the cutting edges 3 of the razor blades 2, as can be seen in particular in the top view of FIG. 1.

Both the inner side of the guide strip 18 as well as the inner side of the cover 20 are provided with receiving grooves 26 for the wire 11. Recesses 27 are provided below the guide strip 18 that interengage in a corresponding manner with the projections 14 of the base member 4. The back of the upper part 5, which is formed from the guide strip 18, the cover 20 and the side walls 24, is provided with through passages 28 that correspond with appropriate through passages in the spacer 8.

In the finish installed state, the upper part 5 is placed from above upon the base member 4, which includes the unit 9 that is secured by the wire 11. The upper part 5 is secured in place in, for example, an interlocking manner, or in any other convenient manner. The wire 11 extends in the receiving grooves 26 provided on the inner side of the upper part 5.

Extending the wire 11 in the vicinity of the upper side 12 has the advantage that the underside 29 of the plastic body 1 remains free, so that appropriate mounting or securing systems can be provided.

The present invention is, of course, in no way restricted to the specific disclosure of the specification and drawings, but also encompasses any modifications within the scope of the appended claims.

What I claim is:

1. A razor head, and especially a razor blade unit, disposed at the front end of a handle of a wet razor, comprising:

a plastic body that comprises a guide strip at a front side thereof, and a cover at a back side thereof, with a razor blade means being disposed in said plastic body, and with said cover being provided with a glide strip that is convexly curved and provided with a coating having a gliding property.

2. A razor head according to claim 1, in which said glide strip has a forward leg, and a rear leg, with said rear leg extending at an angle to said forward leg and being connected thereto via a rounded portion.

3. A razor head according to claim 2, in which said cover has an outer surface that is provided with a shallow recess for receiving said glide strip.

4. A razor head according to claim 1, in which said glide strip is a foil.

* * * * *

UNITED STATES PATENT AND TRADEMARK OFFICE

CERTIFICATE OF CORRECTION

PATENT NO. : 5,161,307
DATED : November 10, 1992
INVENTOR(S) : Althaus

It is certified that error appears in the above-indentified patent and that said Letters Patent is hereby corrected as shown below:

On the Title page, item [30], Foreign Application Priority Data: should be Apr. 27, 1990 [DE] Fed. Rep. of Germany ... 9004761[U].

Signed and Sealed this

Twenty-eighth Day of September, 1993

*Attest:*

*Attesting Officer*

BRUCE LEHMAN

*Commissioner of Patents and Trademarks*